US005127508A

United States Patent [19]

Teague

[11] Patent Number: 5,127,508

[45] Date of Patent: Jul. 7, 1992

[54] VENDING APPARATUS

[76] Inventor: George H. Teague, 1989 McJenkin Dr., Atlanta, Ga. 30345

[21] Appl. No.: 399,604

[22] Filed: Aug. 25, 1989

Related U.S. Application Data

[63] Continuation of Ser. No. 205,302, Jun. 10, 1988, abandoned.

[51] Int. Cl.[5] ..... G07F 11/58

[52] U.S. Cl. ..... 194/234; 194/258; 221/77

[58] Field of Search ..... 194/250, 264-266, 194/253-258, 234; 221/76-86

[56] References Cited

U.S. PATENT DOCUMENTS

| | | | |
|---|---|---|---|
| 804,079 | 11/1905 | Williams | 221/82 |
| 2,342,505 | 2/1944 | Worsham | 194/250 |
| 2,895,639 | 7/1959 | Little | 221/266 |
| 3,885,660 | 5/1975 | Burks | 221/76 |
| 4,232,800 | 11/1980 | Martin et al. | 221/241 |
| 4,502,584 | 5/1985 | Lambiris | 194/55 |

*Primary Examiner*—F. J. Bartuska
*Attorney, Agent, or Firm*—Louis T. Isaf

[57] ABSTRACT

A vending machine comprises a plurality of receptacles mounted to a conveyor member, driven through a loop path by a drive shaft which engages the conveyor by gears, pulleys or other appropriate force transmitting devices, which driveshaft is connected to and advanced by a prime mover such as a hand pulled lever arm and which vending apparatus comprises control mechanisms which combine to control the frequency and degree of shaft rotation to assure that a customer pays for each object vended.

56 Claims, 5 Drawing Sheets

VENDING APPARATUS

This application is a continuation of application Ser. No. 07/205,302, filed June 10, 1988, now abandoned.

FIELD OF THE INVENTION

This invention relates generally to the field of vending machines.

BACKGROUND OF THE INVENTION

Although the vending industry is, in general, a very sophisticated industry, newspaper vending has long been the neglected stepchild. Whereas soft drink, candy and cigarette vendors efficiently distribute one item for one exacted fee and have developed elaborate machines for frustrating and often preventing cheating and theft, the newspaper vendors continue to use simplistic vending machines and to rely upon the honor system as the sole means of crime prevention. Unfortunately and sadly, the honor system is failing miserably in many locations across the country. Existing newspaper machines are basicly comprised of a box with a hinged door outfitted with a coin release lock. A dozen or so newspapers are stacked in the box and the door is locked. The honorable customer places his coin in the coin box, unlocks the door, removes one paper from the stack, and closes (relocks) the door. The ever expanding number of dishonorable customers places his coin in the coin box, unlocks the door, takes a newspaper from the stack, and holds the door open or places a stone on the door while other persons freely avail themselves of remaining newspapers.

Addressing the newspaper vending problems has been difficult due to the large size and bulk of the typical newspaper. Unlike soft drinks, candy and cigarettes, newspapers do not lend themselves to vending in typical sophisticated devices where small, streamlined items slip through tubes or drop through chutes or are advanced by augers and springs. Thus, a new vending machine is necessary to address the unique problems of the newspaper industry. Furthermore, no longer can vending machine manufacturer be satisfied with the fact that their machine successfully vends one item at a time. Rather, frustrating would be cheaters and thieves requires a certain amount of genius in design.

SUMMARY OF THE INVENTION

Briefly described, the present invention comprised a vending apparatus which is capable of vending a large variety of items including, but not limited to, newspapers. The vending machine of the present invention comprises a plurality of recetacles, preferably in the form of tube shaped canisters open at one end, into which can be inserted a rolled newspaper or other items to be vented. The canisters are mounted within a casing. In the preferred embodiment, the canisters are mounted to a conveyor member, such as two parallel chains, which is driven through a loop path, or path of other configuration, within the vending machine case. As the conveyor is driven through a path, each of the canisters is brought alternately into alignment with an acces ports through which a customer can reach from outside the casing and remove the newspaper or other object from the then-aligned canister.

The conveyor is driven through its loop by a drive shaft which engages the conveyor by gears, pulleys or other appropriate force transmitting devices. In the perferred embodiment, the conveyor is in the form of two parallel chains looped about two or more wheelsets. The wheelsets include wheels with gear teeth formed at their peripheries for engaging the chain links. The driveshaft is connected to and advanced by a prime mover such as a hand pulled level arm or an electric motor. The vending apparatus of the present invention further comprises mechanisms which combine to control the frequency and degree of shaft rotation to assure that a customer pays for each object vended.

It is, therefore, an object of the present invention to provide a vending machine which is capable of displaying one newspaper at a time for access by a customer.

Another object of the present invention is to provide a vending machine which vends newspaper at the frequency of one newspaper per one pre-established payment.

Another object of the present invention is to provide a vending machine capable of vending newspaper which frustrate the efforts of cheaters and thieves.

Another object of the present invention is to provide an apparatus for controlling the rotation of a shaft to thus predict the frequency and degree of shaft rotation.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
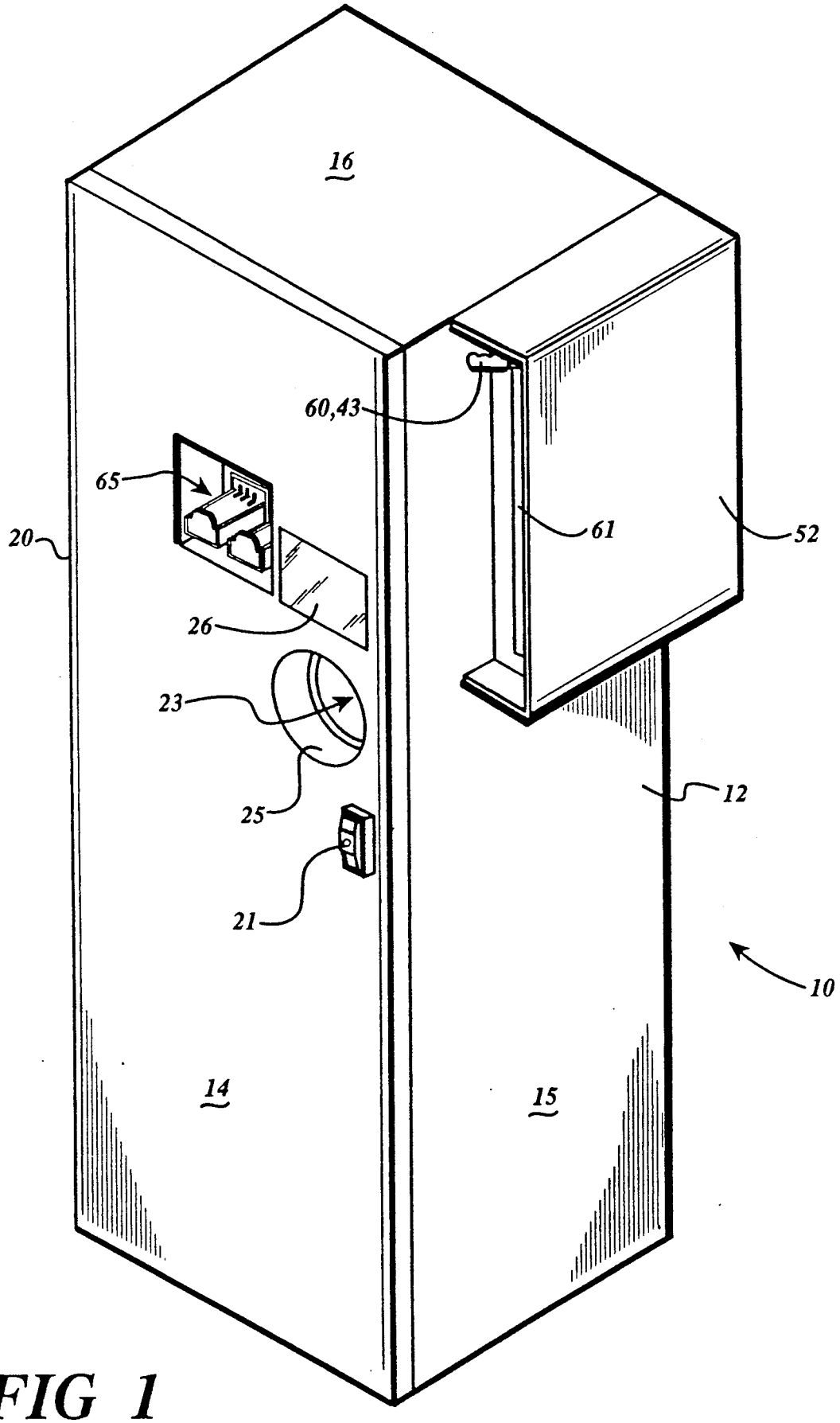
FIG. 1 is a pictorial view of a vending apparatus in accordance with a preferred embodiment of the present invention.
Figure 2:
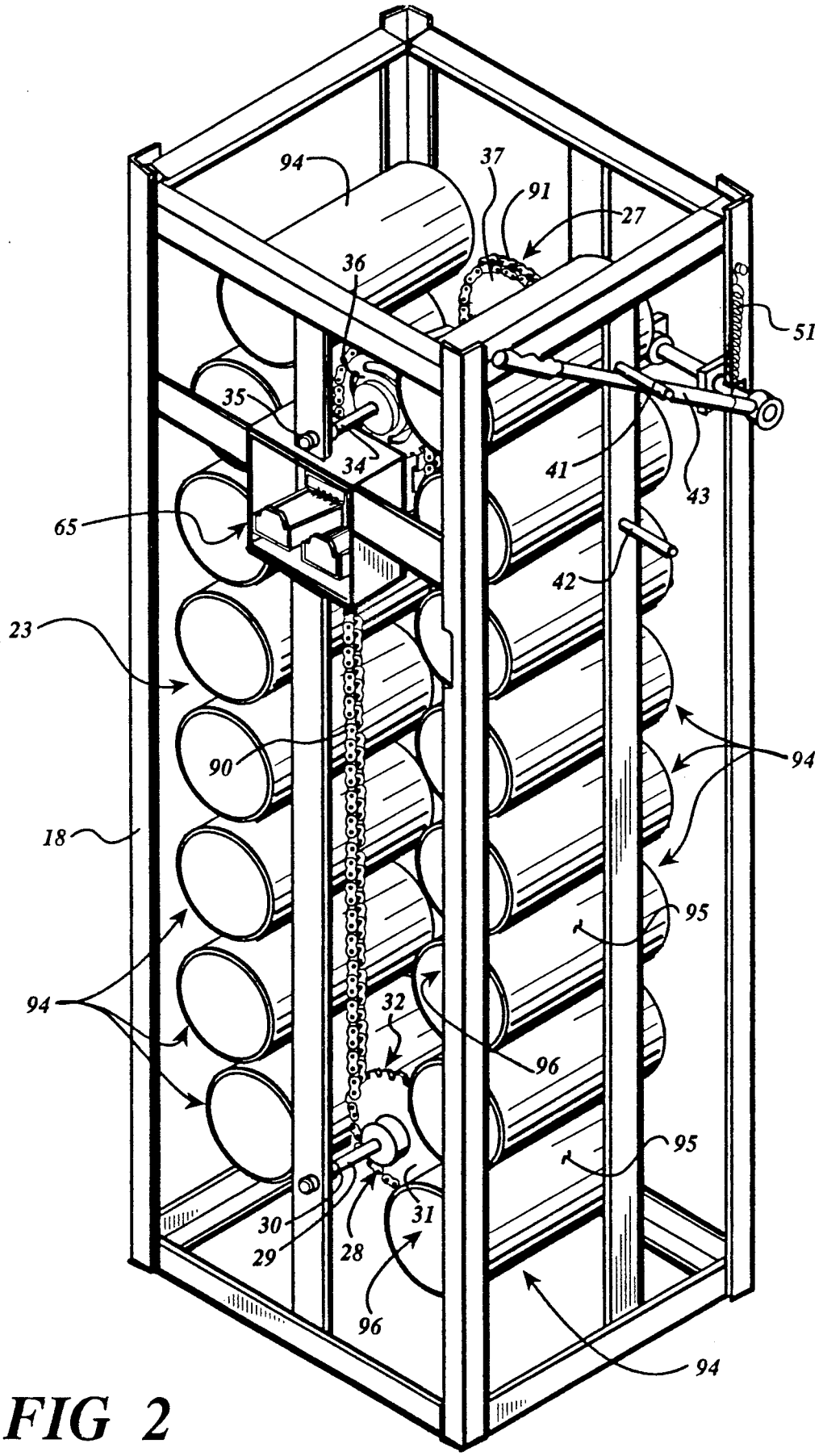
FIG. 2 is a pictorial view of the vending apparatus of FIG. 1, with exterior walls removed.

Referring now in greater detail to the drawing in which like numerals represent like components throughout the several views, the Vending Appararus 10 of the present invention is seen in FIGS. 1 and 2 as comprising a causing 12 which includes a front wall 14, side wall 15 and back and opposite side walls (not seen). The casing 12 also includes a top wall 16 and bottom wall (not seen). The walls are supported by a structural frame 18 (seen in FIG. 2). The front wall 14 functions as a door which is hinged to the structural frame 18 along verical edge 20. When the door 14 is closed, it is locked to the frame 18 by a keyed lock 21. The inside of the casings 12 defines a hollow chamber 23. Access to the chamber 23 is had through the open door 14. An access port 25 is formed through the door 14 through which a user can reach the chamber 23 when the door 14 is closed. The door 14 is outfitted with a viewing window 26.

With reference to FIG. 2, two wheel sets 27, 28 are seen mounted to the structure frame 18 and within the chamber 23 of the casing 12. The lower wheel set 28 comprises a shaft 29 mounted by bearings 30 (rear bearing not seen) such that the lower shaft 29 rotates about its elongated axis relative to the structural frame 18. The lower wheel set 28 further comprises two spaced apart wheel elements 31 (rear wheel element not seen). Each of the wheel elements 31 is firmly attached to the lower shaft 29 for rotation with the shaft. Each of the wheel elements 31 is formed with radially protruding teeth 32 equally spaced about the entire circumstance of its outer periphery. The upper wheel set 27 includes a shaft 34 mounted by bearings 35 to the structure frame 18 such that the shaft rotates about its elongated axis 40 relative to the frame. The upper wheel set 27 also includes two spaced apart wheel elements 36, 37 which are each mounted tightly to the upper shaft 34 for rotation with the shaft. Each of the wheel elements 36, 37 is formed eith radially protruding teeth 38, 39 spaced equidistantly about the entire circumference of its outer periphery.

Figure 3:
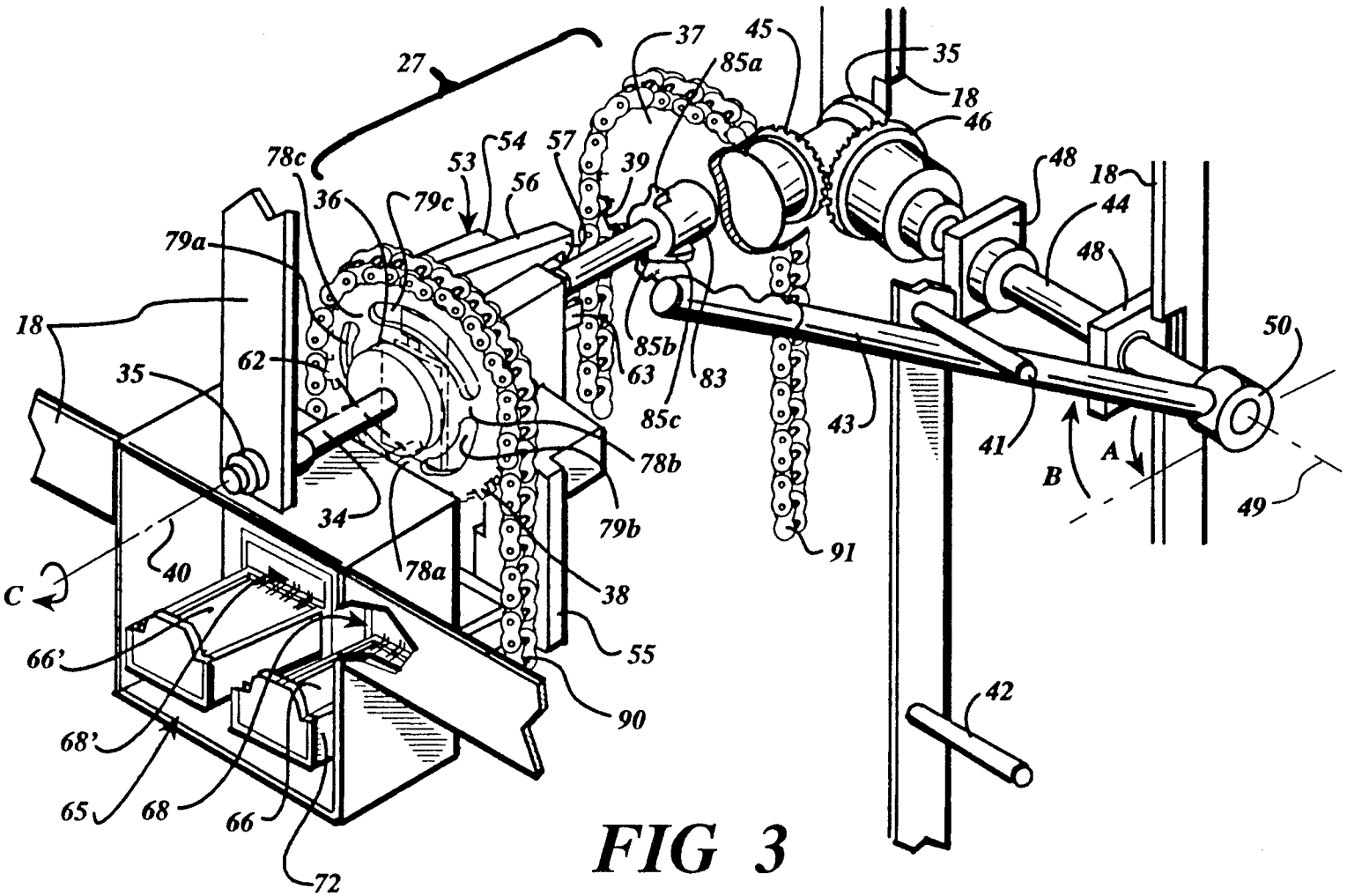
FIG. 3 is an isolated, pictorial view of the driving and control mechanism of the vending apparatus of FIG. 1.
Figure 4:
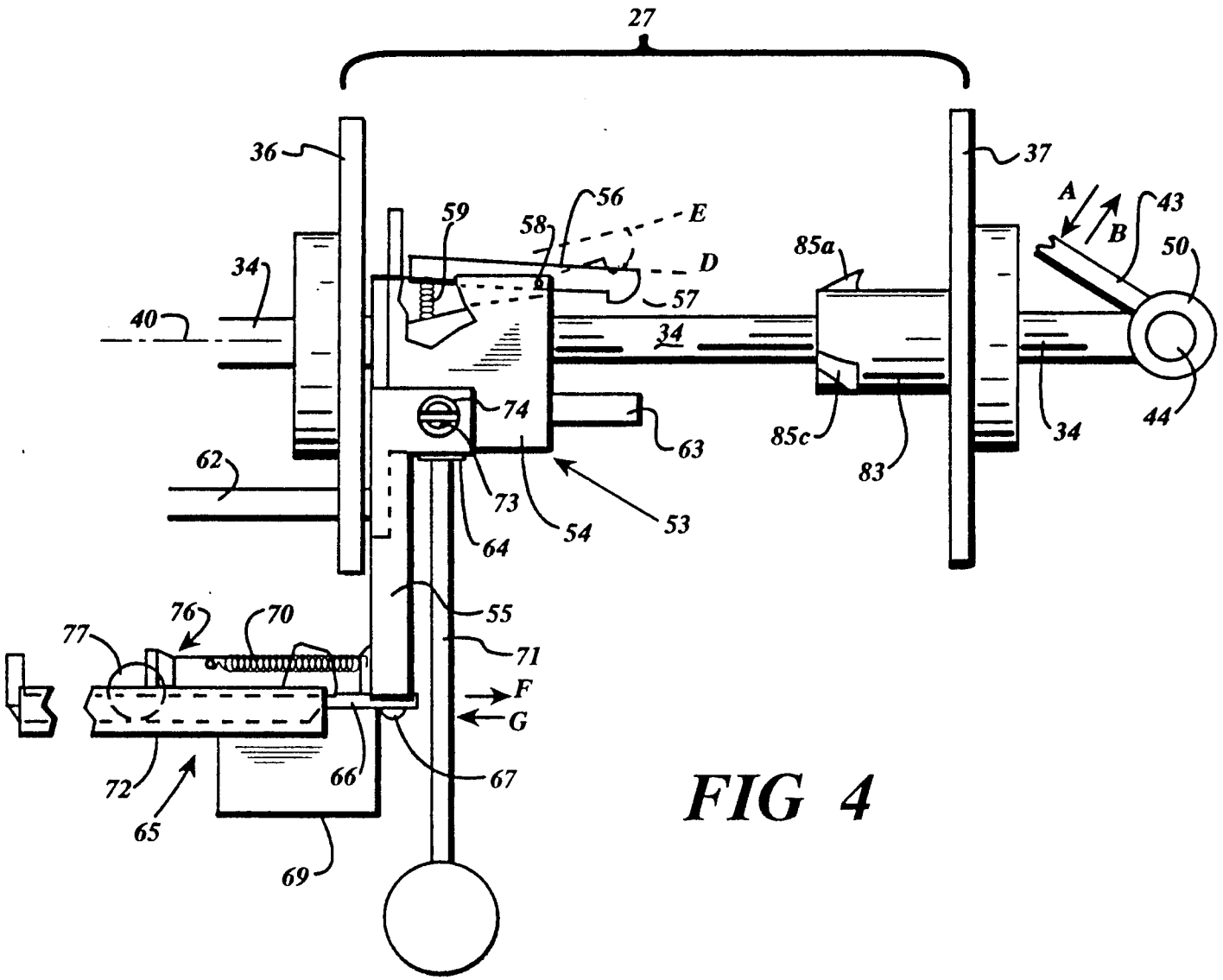
FIG. 4 is an isolated, side view of certain components of the driving and control mechanism seen in FIG. 3 showing the traveler assembly in the frontmost position.

With reference to FIGS. 3 and 4, the upper shaft 34 is seen as being in driven relationship with a level arm 43 through the linkage of a transfer bar 44 and meshing, miter gears 45, 46, whereby downward movement (arrow A in FIG. 3) effects clockwise rotation (arrow C in FIG. 3) of the upper shaft 34 and, thus, of the upper wheel set 27. The bar 44 is seen as mounted by blocks and bearings 48 to the structural frame 18 for rotation of the bar about its elongated axis 49; and the bar is connected by a one way bearing 50 to the lever arm 43 to effect a ratchet action. Thus, downward movement (arrow A) of the lever arm effects rotation of the bar 44 about its axis 49; whereas upward movement (arrow B) of the lever arm has not rotating effect on the bar. Furthermore, the bearings 35 by which the upper shaft 34 si mounted to the structural frame 18 are one way bearings which allow free clockwise rotation (arrow C) of the upper shaft, but resist counterclockwise rotation. The degree of motion of the lever arm 43 is limited by (among other mechanisms described below) limit pins 41, 42. A return spring 51 biases the lever arm 43 to an upper position against the upper limit pin 41. As noted in FIG. 1, the spring 51, arm 43 and limit pins 41, 42, are housed in a protective cover 52 attached to the casing 12, with the lever handle 60 protruding from an elongated slot 61.

A traveler assembly 53 is mounted in a sliding fashion to the upper shaft 34 between the two wheel elements 36, 37. The traveler assembly 53 of the disclosed embodiment is seen as including a travel block 54 through which the shaft 34 passes, which block will slide axially (as on bearings) along the shaft. The traveler assembly 53 further comprises a first blocking rod 62 protruding forward from the block 54 and aligned parallel to the shaft 34, a second blocking rod 63 protruding rearward from the block 54 and aligned parallel to the shaft 34, and a latch member 56 which is formed with a hooked head 57. The latch member 56 is pivotally connected to the travel block 54 at pivot pin 58 to display a pivoting freedom of movement as represented between points D and E shown in FIG. 4. The latch member is biased by a spring 59 to position "D".

Figure 6:
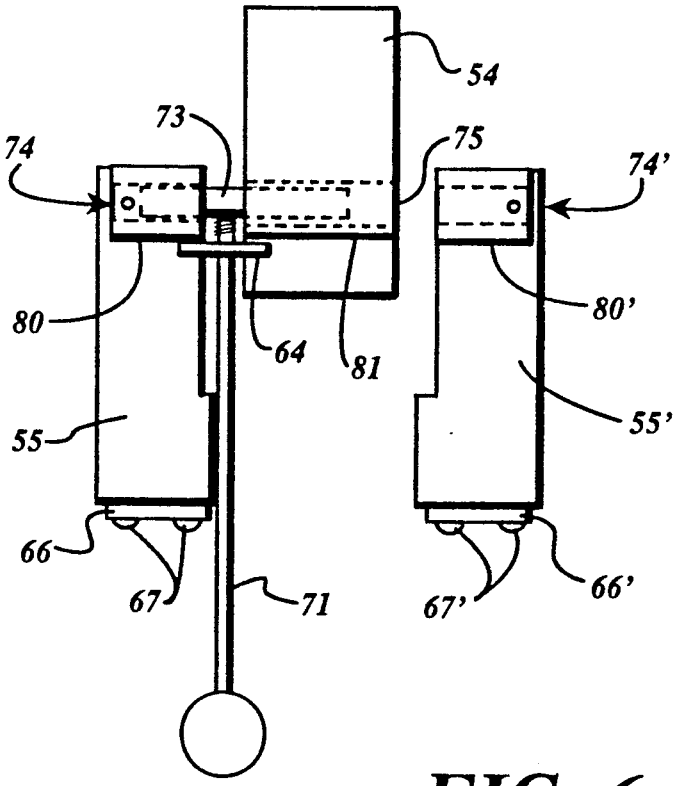
FIG. 6 is an isolated rear view of certain components of the control mechanism of FIG. 3.

The vending apparatus 10 is further seen as comprising a coin activated linkage 65, mounted to the structural frame 18 and accessed through the closed door 14. The transfer linkage 65 includes a push plate 66 mounted to a slide tray 72 independent, sliding movement within the tray. The push plate 67 of the coin activated linkage 65 is seen as being rigidly attached (as by screws 67) to a transfer plate 55. The transfer plate 55 extends upward from the push plate 66 to a position adjacent the travel block 54 of the traveler assembly 53. (See FIG. 6.) The transfer plate 55 is linked to the travel block 54 by a link-pin 73 which occupies a cylindrical channel 74 bored in the transfer plate and a grooved channel 75 formed in the travel block 54. Thus, movement of the push plate 66 in the direction of arrow "F" likewise moves the transfer plate 55 and, thus, the travel block 54 in the direction of arrow "F". The link pin 73 is held in place spanning between the transfer plate 55 and travel block 54 by a selection lever 71 and wahser 64. The selection lever 71 is threaded into the link pin 73 (as seen in FIG. 6) and the washer 64 is retained at the threaded end of the lever. The washer 64 rests against an edge 80 of the transfer plate 55 and against an edge 81 of the travel block 54. Thus, screw-in actionof the selection lever 71 into the link pin 73 acts as a vice to grip the transfer plate 55 and block 54.

In a manner known in the industry, the coin activated linkage 65 also includes a coin released locking mechanism 76 which restricts the amount of movement of the push plate 66 in the direction of arrow "F". The locking mechanism 76 is formed with cooperating coin slots 68 for acceptance of a designated assortment of coins 77. Without coins, the push plate 66 can move only part of its otherwise full motion in direction "F". When the designated assortment of coins 77 are placed in the cooperating coin slots 68, the push plate 66 is "released" to travel full motion in direction "F", in a manner known in the industry. Once the push plate 66 has reached a limit point in direction "F", the coins fall out of the coin slot 68 and into a coin box 69. A spring 70 provides a biasing force on the push plate 66 in the direction of arrow "G". The coin activated linkage 65 is of a type well known in the industry and its structure and operation are considered well known. Therefor, further explanation is not deemed necessary for purposes of this disclosure. An example of an appropriate coin activated linkage 65 is as seen in the disclosure of U.S. Pat. No. 4,502,584, the specification of which is included herein by this reference.

A second push plate 66' and second transfer plate 55' are provided in the disclosed embodiment. This second push plate 66' includes a different arrangement of coin slots 68' which accept an assortment of coins different from the assortment of coins accepted by the coin slot 68 of the first push plate 66. By loosening the vise grip of the selection lever 71 and washer 64, the link pin is selectively disengaged and slid through the grooved channel 75 to the cylindrical channel 74' of the second transfer plate 55' where it is tightened to link the second push plate 66' to the traveler assembly 53. The selection lever 71 moves with the pin 73 across the travel block 54 since the grooved channel 75 is opened along the bottom of the block.

With reference to FIG. 3, the front, wheel element 36 of the upper wheel set 27 is seem as being formed so as to define three spoke members 78 displaced about the shaft 34. Adjacent spoke members 78 defining open channels 79 between them. Also mounted to the upper shaft 34 is a spur member 83 which is tightly connected for rotation with the upper shaft 34. The spur member 83 is formed with three, radially protruding knobs 85 which are displaced about the shaft 34. In the preferred embodiment , the spoke members 78*a, b, c*, are displaced equidistantly about the shaft 34. Furthermore, in the preferred embodiments, the relative positioning of the first blocking rod 62, latch member 56, spoke members 78 and knobs 85 in such that when a spoke member (1.e. 78*a*) is in abutment with the first blocking rod 62 (as in FIG. 3), a knob (i.e. 85*a*) is in direct, axial alignment with the latch member 56; in order that, as the travel block 54 is moved rearward along the shaft 34, the hooked head 57 will engage and hook to the aligned knob (85*a*).

a first chain 90 is looped about the front eheel element 36 of the upper wheel set 27 and about the front wheel element 31 of the lower wheel set 28, with the respective teeth 38, 32 engaging the chain links. A second chain 91 is looped about the rear wheel element 37 of the upper wheel set 27 and about the rear wheel element (not seen) of the lower wheel set 28, with the respective teeth engaging the chain links. A plurality of resceptacles 94 are welded to or otherwise attached to the two chains 90, 91. The receptacles 94 are in the form of tubular canisters formed of a cylindrical wall 95 and a rear wall (not seen), being open at the front end 96.

OPERATION

Operation of the vending apparatus 10, assembled in accordance with the above described preferred embodiment and with reference to attached drawing figures, follows. To the consuming enviroment, the vending apparatus 10 appears as seen in FIG. 1. An employee of a newspaper publisher unlocks the lock 21, open the door 14 and inserts a rolled newspaper into each canister 94 through the open end 96 of each canister. Since, in this particular example, there are two push plates, 66, 66' in the coin activated linkage 65, the employee selects, from the two choices, the price of the newspaper by moving the select lever 71 and link pin 73 as to "link" the traveler assembly 53 to the appropriate push plate. The door 14 is then closed and locked. When the door 14 is closed, one canister 94 is in direct aligment with the access port 25. The newspaper in the immediately aligned canister 94 is removed by the employee. The next newspaper to be vended is in the canister immediately above the access port 25 can be viewed by a customer, to verify the availability of a newspaper, through the viewing window 26.

In its "idle" condition, waiting for a customer, it is seen that the lever arm 43 is biased by the return spring 51 to its upward position resting against the upper limit pine 41; the traveler assembly 53 is pulled by the push plate 66, through the action of the biasing spring 70, to position the travel assembly in its frontmost position (see FIG. 4) in which the first blocking rod 62 protrudes through one of the open channels 79 between two spoke member 78 of the front, upper wheel element 36. It is seen that this first blocking rod 62 lies in the path of rotation of the spoke members 78 when the travel assembly 53 is in the front position. Thus, to position the canisters 94 in anticipation of a first customer, the employee pulls the lever arm 43, acting as a ratchet, to drive the upper shaft 34, rotating the upper wheel set 27 (and lower wheel set 28) in the direction of arrow "C" until one of the spoke members 78*a* strikes the first blocking rod 62. The blocking rod 62 is prevented from rotation with the spoke member 78*a* by virtue of the rigid linkage from the blocking rod 62 through the travel block 54, transfer plate 55 and push plate 67 to the coin linkage slide tray 72 and, thus, to the structural frame 18. Thus, once a spoke member 78 strikes the first blocking rod 62, the downward shaft driving action of the lever arm 43 is prevented. In the preferred embodiment, the placement of canisters 94 along the conveyor chains 90, 91 is such that when a spoke member 78 strikes the first blocking rod 62, the conveyor chain 90, 91 will have advanced a sufficient distance to align one canister 94 in direct line with the access port 25. The employee removes the newspaper which may have been inserted in the canister first aligned with the access port 25. The vending apparatus is now ready for consumer sales.

Figure 5:
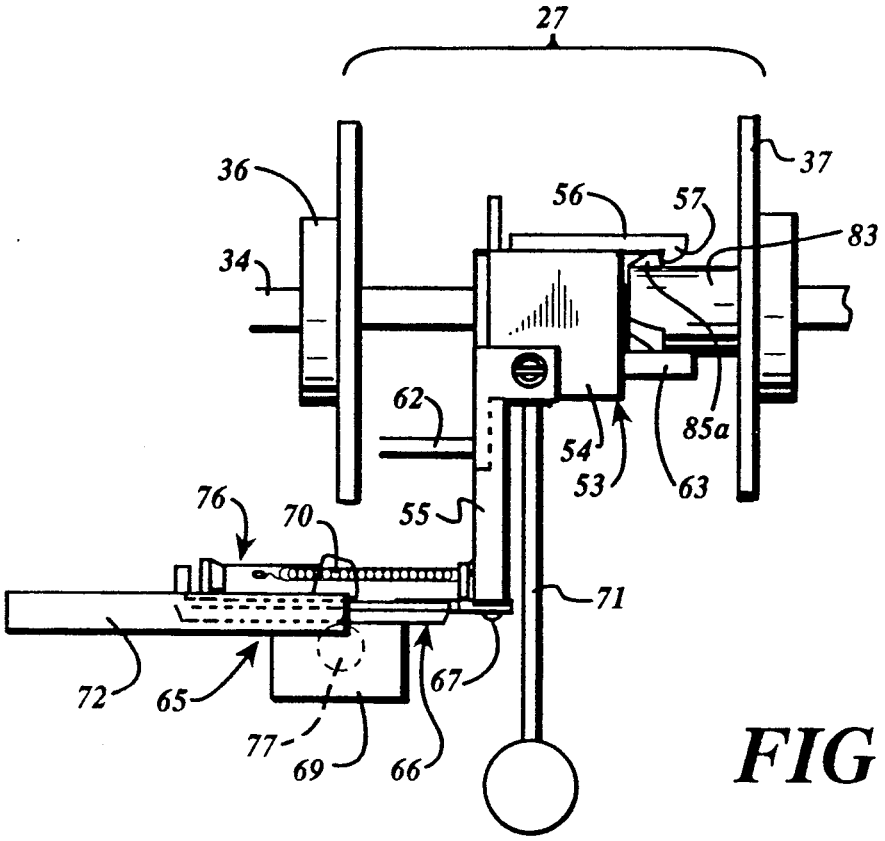
FIG. 5 is an isolated, side view of certain components of the driving and control mechanism see in FIG. 3, showing the traveler assembly in the rearmost position.

A consumer places the appropriate assortment of coins 77 in the coin slot 68 of the appropriate push plat (assume plate 66). With these coins 77 in place to release the blocking mechanism 76, in a typical operation of such coin activated linkages, the customer pushes the push plate inward (arrow "F"), overcoming biasing spring 70, which moves push plate 66 rearward, which forces the traveler assembly 53 to slide rearward along the upper shaft 34. With the push plate 66 fully depressed, the traveler assembly 53 will have been positioned at its rearmost position (see FIG.5) with the hooked head 57 of the latch member 56 pivoting over and finally hooking behind one of the knobs 85 (see knob 85*a* of FIG. 3, 4) of the spur member 83. In the preferred embodiment, at the same point that the traveler assembly 53 has reached the rearmost, latched position, the push plate 66 will have reached the point where the coins will drop out into the coin box 69. The biasing spring 70 will pull on the output plate 67 to return the traveler assembly 53 to its forward position; but the traveler assembly 53, in spite of the pulling action of the spring 70, will remain at the rearward position by action of the hooked latch member 56 and knob 85*a*. It is noted that, as the traveler assembly 53 is moved to the rearward position, the first blocking rod 62 is also moved rearward until, at the rearward position, the first blocking rod 62 is no longer within the path of rotation of the spoke members 78; and, thus, the shaft 34 is not longer prevented from rotation by the first blocking rod 62. It is seen that the customer has now, basically, paid money to free the shaft 34 for rotation. The customer pulls the lever arm 43 downward (Arrow "A") which drives the upper shaft 34 clockwise (arrow "C"). As the shaft 34 rotates, it rotates just enough for the previously blocked spoke member 78*a* to move beyond the first blocking rod 62 and then the hooked head 57 of the latch member 56 slides off the knob 85*a* of the spur member 83, at which point the biasing spring 70 pulls the traveler assembly 53 again to its frontmost position. In the frontmost position, the first blocking rod 62 moves into the next open channel 79*b* and, thus, into the path of rotation of the next spoke member 78*b*. The pulled lever arm 43 continues to rotate the shaft 34, driving the conveyor chains 90, 91 and advancing the cannisters 94 until the next spoke member 78*b* strikes the first blocking rod 62, at which point rotation is prevented. By virtue of the coordinated positioning of the canisters 94 along the conveyor chain 90, 91 in calculated relationship to the length of the path and degree of rotation allowed by the angular displacement of the spoke member 78, one, and only one, new canister is moved into alignment with the access port 25 as the shaft 34 rotates the angular distance between adjacent spoke members 78. The customer removes the one newspaper which he paid for, being that newspaper occupying the canister 94 now in alignment with the access port 25. When the customer releases the lever arm 43, it is returned by the spring 51 to the upper limit pin 41 to await the next customer.

Without limiting the breadth and variety of functions and operations of the present invention, the following explains a few of the security functions:

A. Unless a customer pays as explained above, the user can not advance the conveyor chains 90, 91 by pulling down the lever arm 43, since rotation of the upper shaft 34 is prevented by a spoke member 78 striking the first blocking rod 62.

B. A user can not advance the conveyor chain 90, 91 by reaching through the access window and pushing down on the canisters 94, because clockwise rotation is prevented by blocking action of the spoke members 78 and first blocking rod 62; nor can users push up on the canisters to reverse the conveyor chain, because of the anti-rotation function of the one way bearings 35 and also because of the linkage through miter gears, 45, 46 to the lever arm 43, upward motion of which is blocked by the upper limit pin 41.

C. The user can not insert one set of coins in the input plate 66 and then try to use that one set of coins to somehow continuously advance the conveyor chain 90, 91 to acquire more than a single newspaper because the first blocking rod 62 does not immediately release the spoke member 78 as the traveler assembly 53 moves rearward; rather the first blocking rod 52 remains within the path of rotation of the spoke members 78 until immediately prior to (or, in preferred embodiment, slightly after) the second blocking rod 63 has moved into the path of rotation of the knobs 85 on spur member 83. Thus, the user can not move the traveler assembly 53 partly rearward and successfully "freewheel" the conveyor chains. Furthermore, in the preferred embodiment, the first blocking rod 62 remains within the path of the spokes 78 until immediately prior to the point at which the latch member 56 hooks a knob 85 and the coins drop into the coin box.

Whereas the presently preferred embodiment discloses the use of spoke members 78 to function as rod engaging posts in cooperation with the first blocking rod 62, alternate embodiments of the present invention separate the rod engaging posts 78 from the wheel element 36 and provide separately mounted rod engaging posts which are mounted to or formed as part of the shaft 34 and rotate with the shaft and wheel elements. For example, the rod engaging posts 78 are, in an alternate embodiment, formed as knobs on a spur member similar to the spur member 83. In such embodiments, appropriate modification to the positioning and length of linkages, posts and rods is appropriate to provide cooperating and non-interfering functions of the first blocking rod 62, wheel element 36 and rod engaging posts 78. Furthermore, in alternate embodiments, the number of rod engaging post 78 is not limited to three as shown in th diclosed embodiment. Rather, it is within the scope of the invention to provide one or more rod engaging posts 78; where the number of rod engaging posts is coordinated with specifications including, but not limited to, the radius of the wheel elements and relative spacing between canisters 94 to assure access to only one canister for the payment of one fee.

Also, in the preferred embodiment herein disclosed, the knobs 85 of the spur member 83 function as both latching post for latch member 56 and as stopping post for the second blocking rod 63. In alternate embodiments, it is within the scope of the present invention to provide separate sets of knobs mounted as part of the shaft 34, where one set functions as latching post and the second set as rear, stopping posts. In such an alternate embodiment, the latching post member, preferably, remains similar to the spur member 83 of the disclosed embodiment, with the latching posts angularly displaced at distances equal to the displacement of the front, rod engaging post 78; while the set of knobs used as the rear, stopping posts are, in the alternative, more in number than the front, rod engaging post 78 and are angularly displaced closer together, though still numbered and positioned such that the second blocking rod 63 will pass between them during rearward movement of the traveler assembly 53.

Whereas, the conveyor function of the present invention is, in the preferred embodiment, provided by a combination of chains 90, 91 and tooth bearing wheel sets 27, 28, alternate, though less preferred embodiments use alternate conveyor systems such as narrow belts tracking on wheel sets in the form of grooved pulleys. Another, alternate embodiment includes a conveyor in the form of a large, circular drum to which canisters 94 are mounted to the outer periphery of the drum and the drum is mounted to and driven by a single shaft at the center of the drum, wherein the driving and control mechanism of the present invention cooperate with the central shaft of the drum.

It is within the scope of the present invention to modify the paths followed by the conveyor chains 90, 91, and thus canisters 94, by adding additional idler wheel sets, such as wheel set 28, over which the chains pass. The casing 12, in such alternate embodiment, is modified to accomodate the newly defined conveyor path. Furthermore, it is within the scope of the present invention that, in alternate embodiments, a first shaft and wheel set, such as lower wheel set 28 is in driven engagement with the lever arm 43 or other prime mover, while a second shaft, such as upper shaft 34, is the controlled shaft, controlled by the coin activated linkage 65 or other activating mechanism and the traveler assembly 53.

Whereas the prime mover (i.e. lever arm 43) and the activating mechanism (i.e. coin activated linkage 65) of the herein disclosed, preferred embodiment are disclosed as mechanical devices, it is within the scope of the present invention to provide alternate embodiments in which one or more of the prime mover and activating mechanism are electronically controlled. One example of such an alternate embodiment includes an activating mechanism which controls movement of the traveler assembly by activation of a servo-motor in response to the insertion of a credit card and/or the entry of appropriate code in key pad. In another alternate embodiment, the prime mover is a torque switch deactivated electric motor which is activated by an electric signal from an appropriate signal from the activating mechanism 65 and which is subsequently deactivated in response to the generation of a threshold torque by the blocking of a rod engaging post 78 with the first blocking rod 62.

Whereas the present invention has been described in detail with specific reference to particular embodiments thereof, it will be understood that variations and modifications may be effected within the spirit and scope of the present invention as hereinbefore described and as defined in the appended claims.

I claim:

1. Apparatus for providing controlled rotation of a shaft, which shaft is mounted for rotation about its elongated axis, the elongated axis defining the axis of rotation, said apparatus comprising:

shaft rotating means for rotating the shaft about the axis of rotation;

a chock member mounted to the shaft for rotation with the shaft, whereby blocking rotation of said chock member prevents rotation of the shaft, said chock member comprising, at least, a post member projecting radially outward from said axis of rotation;

a travelling member mounted to the shaft for movement axially along the shaft, said travelling member being prevented from rotation with the shaft, said travelling member comprising, at least, a protruding bar, and said travelling member being movable from a first position in which said bar is within the path of rotation of said post member of said chock member and a second position in which said bar is not within the path of rotation of said post member of said chock member;

biasing means for biasing said travelling member to said first position; and positioning means for at least temporarily overcoming said biasing and moving said travelling member from said first position to said second position.

2. Apparatus of claim 1, further comprising:

locking means for preventing movement of said travelling member by said positioning means; and releasing means for releasing said locking means in response to satisfaction of a defined prerequisite to thus allow movement of said travelling member by said positioning means.

3. Apparatus of claim 2, wherein said defined prerequisite to which said releasing means responds is an insertion of coins.

4. Apparatus of claim 2, wherein said defined prerequisite to which said releasing means responds is the detection of a coded entry.

5. Apparatus of claim 1, wherein said positioning means comprises, at least:

force applying means for applying a force on said travelling member to overcome said biasing and to move said travelling member from said first position to said second position; and latch means for releasably holding said travelling member in said second position after said force is removed, said latch means releasing the hold on said travelling member in response to rotation of the shaft.

6. Apparatus of claim 5, wherein said force applying means comprises, at least, means for accepting a manually exerted force and means conveying said manually exerted force to a force applied on said travelling member.

7. Apparatus of claim 1, further comprising: a second chock member mounted to the shaft for rotation with the shaft, whereby blocking rotation of said second chock member prevents rotation of the shaft, said second chock member comprising, at least, a post member projecting radially outward from said axis of rotation, said post member of said second chock member being displaced axially from said post member of said first chock member; and wherein said travelling member comprises, at least, a second protruding bar which second protruding bar is within the path of rotation of said post member of said second chock member when said travelling member is in said second position.

8. Apparatus of claim 1, wherein said shaft rotating means comprises, at least, means for rotating the shaft in response to manually exerted force.

9. Apparatus of claim 1, wherein said chock member comprises a spoked wheel including, at least, a plurality of radially spaced apart spokes, each functioning as a post member.

10. Apparatus of claim 1, wherein said first chock member is integrally formed as a part of the shaft.

11. Apparatus of claim 7, wherein said first chock member and said second chock member are integrally formed as part of the shaft.

12. Vending apparatus, comprising:

a casing including, at least, a structural frame, an exterior wall supported by said frame and defining an inside chamber, and an access port formed in said wall of said casing and defining a passage from the outside environment to said inside chamber;

a conveyor member mounted within said chamber of said casing for movement through a predefined path within said chamber;

a plurality of receptacles mounted to said conveyor member and spaced apart along said predefined path, said receptacles moving with said conveyor member, each said receptacle being capable of holding at least one object to be vended;

a driving shaft mounted to said frame, said driving shaft being mounted for rotation about its elongated axis which elongated axis defines its axis of rotation;

conveyor engaging means for effecting movement of said conveyor member through said path in response to rotation of said driving shaft;

shaft rotating means for rotating said shaft about said axis of rotation;

a chock member mounted to said shaft for rotation with said shaft, whereby blocking rotation of said chock member prevents rotation of said shaft, said chock member comprising, at least, a post member projecting radially outward from said axis of rotation;

a travelling member mounted to said shaft for movement axially along said shaft, said travelling member being prevented from rotation with said shaft, said travelling member comprising, at least, a protruding bar, and said travelling member being movable between a first position in which said bar is within the path of rotation of said post member of said chock member and a second position in which said bar is not within the path of rotation of said post member of said chock member;

biasing means for biasing said travelling member to said first position; and positioning means for at least temporarily overcoming said biasing and moving said travelling member from said first position to said second position.

13. Apparatus of claim 12, further comprising:

locking means for preventing movement of said travelling member by said positioning means; and releasing means for releasing said locking means in response to satisfaction of a defined prerequisite to thus allow movement of said travelling member by said positioning means.

14. Apparatus of claim 13, wherein said defined prerequisite to which said releasing means responds is an insertion of coins.

15. Apparatus of claim 13, wherein said defined prerequisite to which said releasing means responds is the detection of a coded entry.

16. Apparatus of claim 12, wherein said positioning means comprises, at least:

force applying means for applying a force on said travelling member to overcome said biasing and to move said travelling member from said first position to said second position; and latch means for releasably holding said travelling member in said second position after said force is removed, said latch means releasing the hold on said travelling member in response to rotation of said shaft.

17. Apparatus of claim 16, wherein said force applying means comprises, at least, means for accepting a manually exerted force and means for conveying said manually exerted force to a force applied on said travelling member.

18. Apparatus of claim 12, further comprising: a second chock member mounted to said shaft for rotation with said shaft, whereby blocking rotation of said second chock member prevents rotation of said shaft, said second chock member comprising, at least, a post member projecting radially outward from said axis of rotation, said post member of said second chock member being displaced axially from said post member of said first chock member; and wherein said travelling member comprises, at least, a second protruding bar which second protruding bar is within the path of rotation of said post member of said second chock member when said travelling member is in said second position.

19. Apparatus of claim 12, wherein said shaft rotating means comprises, at least, means for rotating the shaft in response to a manually exerted force.

20. Apparatus of claim 12, wherein said chock member comprises a spoked wheel including, at least, a plurality of radially spaced apart spoked, each functioning as a post member.

21. Apparatus of claim 12, wherein said first chock member is integrally formed as a part of the shaft.

22. Apparatus of claim 18, wherein said first chock member and said second chock member are integrally formed as part of the shaft.

23. Apparatus for providing controlled rotation of a shaft, which shaft is mounted for rotation about its elongated axis, the elongated axis defining the axis of rotation, said apparatus comprising:

shaft rotating means for rotating the shaft about the axis of rotation;

a chock member mounted to the shaft for rotation with the shaft, whereby blocking rotation of said chock member prevents rotation of the shaft, said chock member comprising, at least, a post member projecting radially outward from the axis of rotation;

a travelling member prevented from rotation with the shaft, said travelling member comprising, at least, a protruding bar, and said travelling member being movable between a first position in which said bar is within the path of rotation of said post member of said chock member and a second position in which said bar is not within the path of rotation of said post member of said chock member;

biasing means for biasing said travelling member to said first position;

positioning means for at least temporarily overcoming said biasing and moving said travelling member from said first position to said second position;

locking means for preventing movement of said travelling member by said positioning means; and releasing means for releasing said locking means in response to satisfaction of a defined prerequisite to thus allow movement of said travelling member by said positioning means.

24. Apparatus of claim 23, wherein said defined prerequisite to which said releasing means responds is an insertion of coins.

25. Apparatus of claim 23, wherein said defined prerequisite to which said releasing means responds is the detection of a coded entry.

26. Apparatus of claim 23, wherein said positioning means comprises, at least:

force applying means for applying a force on said travelling member to overcome said biasing and to move said travelling member from said first position to said second position: and latch means for releasably holding said travelling member in said second position after said force is removed, said latch means releasing the hold on said travelling member in response to rotation of the shaft.

27. Apparatus of claim 26, wherein said force applying means comprises, at least, means for accepting a manually exerted force and means for conveying said manually exerted force to a force applied on said travelling member.

28. Apparatus of claim 23, wherein said shaft rotating means comprises, at least, means for rotating the shaft in response to a manually exerted force.

29. Apparatus of claim 23, wherein said chock member comprises a spoked wheel including, at least, a plurality of radially spaced apart spokes, each functioning as a post member.

30. Apparatus of claim 23, wherein said chock member is integrally formed as a part of the shaft.

31. Apparatus for providing controlled rotation of a shaft, which shaft is mounted for rotation about its elongated axis, the elongated axis defining the axis of rotation, said apparatus comprising:

shaft rotating means for rotating the shaft about the axis of rotation;

a chock member mounted to the shaft for rotation with the shaft, whereby blocking rotation of said chock member prevents rotation of the shaft, said chock member comprising, at least, a post member projecting radially outward from the axis of rotation;

a travelling member prevented from rotation with the shaft, said travelling member comprising, at least, a protruding bar, and said travelling member being movable between a first position in which said bar is within the path of rotation of said post member of said chock member and a second position in which said bar is not within the path of rotation of said post member of said chock member;

biasing means for biasing said travelling member to said first position;

positioning means for at least temporarily overcoming said biasing and moving said travelling member from said first position to said second position;

a second chock member mounted to the shaft for rotation with the shaft, whereby blocking rotation of said second chock member prevents rotation of the shaft, said second chock member comprising, at least, a post member projecting radially outward from the axis of rotation, said post member of said second chock member being displaced axially from said post member of said first chock member; and said travelling member further comprising, at least, a second protruding bar which second protruding bar is within the path of rotation of said post member of said second chock member when said travelling member is in said second position.

32. Apparatus of claim 31, wherein said chock member and said second chock member are integrally formed as part of the shaft.

33. Vending apparatus, comprising:

a casing including, at least, a structural frame, an exterior wall supported by said frame and defining an inside chamber, and an access port formed in said wall of said casing and defining a passage from the outside environment to said inside chamber;

a conveyor member mounted within said chamber of said casing for movement through a predefined path within said chamber;

a plurality of receptacles mounted to said conveyor member and spaced apart along said predefined path, said receptacles moving with said conveyor member, each said receptacle being capable of holding at least one object to be vended;

a shaft mounted to said frame, said shaft being mounted for rotation about its elongated axis which elongated axis defines its axis of rotation;

conveyor engaging means for effecting movement of said conveyor member through said path in response to rotation of said shaft;

shaft rotating means for rotating said shaft about the axis of rotation;

a chock member mounted to said shaft for rotation with said shaft, whereby blocking rotation of said chock member prevents rotation of said shaft, said chock member comprising, at least, a post member projecting radially outward from the axis of rotation;

a travelling member prevented from rotation with said shaft, said travelling member comprising, at least, a protruding bar, and said travelling member being movable between a first position in which said bar is within the path of rotation of said post member of said chock member and a second position in which said bar is not within the path of rotation of said post member of said chock member;

biasing means for biasing said travelling member to said first position;

positioning means for at least temporarily overcoming said biasing and moving said travelling member from said first position to said second position;

locking means for preventing movement of said travelling member by said positioning means; and releasing means for releasing said locking means in response to satisfaction of a defined prerequisite to thus allow movement of said travelling member by said positioning means.

34. Apparatus of claim 33, wherein said defined prerequisite to which said releasing means responds is an insertion of coins.

35. Apparatus of claim 33, wherein said defined prerequisite to which said releasing means responds is the detection of a coded entry.

36. Apparatus of claim 33, wherein said positioning means comprises, at least:

force applying means for applying a force on said travelling member to overcome said biasing and to move said travelling member from said first position to said second position; and latch means for releasably holding said travelling member in said second position after said force is removed, said latch means releasing the hold on said travelling member in response to rotation of said shaft.

37. Apparatus of claim 36, wherein said force applying means comprises, at least, means for accepting a manually exerted force and means for conveying said manually exerted force to a force applied on said travelling member.

38. Apparatus of claim 33, wherein said shaft rotating means comprises, at least, means for rotating said shaft in response to a manually exerted force.

39. Apparatus of claim 33, wherein said chock member comprises a spoked wheel including, at least, a plurality of radially spaced apart spokes, each functioning as a post member.

40. Apparatus of claim 33, wherein said chock member is integrally formed as a part of said shaft.

41. Vending apparatus, comprising:

a casing including, at least, a structural frame, an exterior wall supported by said frame and defining an inside chamber, and an access port formed in said wall of said casing and defining a passage from the outside environment to said inside chamber;

a conveyor member mounted within said chamber of said casing for movement through a predefined path within said chamber;

a plurality of receptacles mounted to said conveyor member and spaced apart along said predefined path, said receptacles moving with said conveyor member, each said receptacle being capable of holding at least one object to be vended;

a shaft mounted to said frame, said shaft being mounted for rotation about its elongated axis which elongated axis defines its axis of rotation;

conveyor engaging means for effecting movement of said conveyor member through said path in response to rotation of said shaft;

shaft rotating means for rotating said shaft about the axis of rotation;

a chock member mounted to said shaft for rotation with said shaft, whereby blocking rotation of said chock member prevents rotation of said shaft, said chock member comprising, at least, a post member projecting radially outward from the axis of rotation;

a travelling member prevented from rotation with said shaft, said travelling member comprising, at least, a protruding bar, and said travelling member being movable between a first position in which said bar is within the path of rotation of said post member of said chock member and a second position in which said bar is not within the path of rotation of said post member of said chock member;.

biasing means for biasing said travelling member to said first position;

positioning means for at least temporarily overcoming said biasing and moving said travelling member from said first position to said second position;

a second chock member mounted to said shaft for rotation with said shaft, whereby blocking rotation of said second chock member prevents rotation of said shaft, said second chock member comprising, at least, a post member projecting radially outward from the axis of rotation, said post member of said member of said first chock member; and said travelling member further comprising, at least, a second protruding bar which second protruding bar is within the path of rotation of said post member of said second chock member when said travelling member is in said second position.

42. Apparatus of claim 41, wherein said first chock member and said second chock member are integrally formed as part of said shaft.

43. Apparatus for providing controlled rotation of a shaft, which shaft is mounted for rotation about its elongated axis, the elongated axis defining the axis of rotation, said apparatus comprising:

shaft rotating means for rotating the shaft about the axis of rotation;

a chock member mounted to the shaft for rotation with the shaft, whereby blocking rotation of said chock member prevents rotation of the shaft, said chock member comprising, at least, a post member projecting radially outward from the axis of rotation;

a travelling member prevented from rotation with the shaft, said travelling member comprising, at least, a protruding bar, and said travelling member being movable between a first position in which said bar is within the path of rotation of said post member of said chock member and a second position in which said bar is not within the path of rotation of said post member of said chock member;

biasing means for biasing said travelling member to said first position;

positioning means for at least temporarily overcoming said biasing and moving said travelling member from said first position to said second position;

rotation arrest means for preventing rotation of the shaft beyond a predefined angular displacement when said travelling member is in said second position;

locking means for preventing movement of said travelling member by said positioning means; and releasing means for releasing said locking means in response to satisfaction of a defined prerequisite to thus allow movement of said travelling member by said positioning means.

44. Apparatus of claim 43, wherein said defined prerequisite to which said releasing means responds is an insertion of coins.

45. Apparatus of claim 43, wherein said defined prerequisite to which said releasing means responds is the detection of a coded entry.

46. Apparatus for providing controlled rotation of a shaft, which shaft is mounted for rotation about its elongated axis, the elongated axis defining the axis of rotation, said apparatus comprising:

shaft rotating means for rotating the shaft about the axis of rotation;

a chock member mounted to the shaft for rotation with the shaft, whereby blocking rotation of said chock member prevents rotation of the shaft, said chock member comprising, at least, a post member projecting radially outward from the axis of rotation;

a travelling member prevented from rotation with the shaft, said travelling member comprising, at least, a protruding bar, and said travelling member being movable between a first position in which said bar is within the path of rotation of said post member of said chock member and a second position in which said bar is not within the path of rotation of said post member of said chock member;

biasing means for biasing said travelling member to said first position;

positioning means for at least temporarily overcoming said biasing and moving said travelling member from said first position to said second position, said positioning means comprising, at least, force applying means for applying a force on said travelling member to overcome said biasing and to move said travelling member from said first position to said second position, and latch means for releasably holding said travelling member in said second position after said force is removed, said latch means releasing the hold on said travelling member in response to rotation of the shaft; and rotation arrest means for preventing rotation of the shaft beyond a predefined angular displacement when said travelling member is in said second position.

47. Apparatus of claim 46, wherein said force applying means comprises, at least, means for accepting a manually exerted force and means for conveying said manually exerted force to a force applied on said travelling member.

48. Apparatus for providing controlled rotation of a shaft, which shaft is mounted for rotation about its elongated axis, the elongated axis defining the axis of rotation, said apparatus comprising:

shaft rotating means for rotating the shaft about the axis of rotation;

a chock member mounted to the shaft for rotation with the shaft, whereby blocking rotation of said chock member prevents rotation of the shaft, said chock member comprising, at least, a post member projecting radially outward from the axis of rotation;

a travelling member prevented from rotation with the shaft, said travelling member comprising, at least, a protruding bar, and said travelling member being movable between a first position in which said bar is within the path of rotation of said post member of said chock member and a second position in which said bar is not within the path of rotation of said post member of said chock member;

biasing means for biasing said travelling member to said first position;

positioning means for at least temporarily overcoming said biasing and moving said travelling member from said first position to said second position; and rotation arrest means for preventing rotation of the shaft beyond a predefined angular displacement when said travelling member is in said second position, said rotation arrest means comprising, at least, a second chock member mounted to the shaft for rotation with the shaft, whereby blocking rotation of said second chock member prevents rotation of the shaft, said second chock member comprising, at least, a post member projecting radially outward from the axis of rotation, said post member of said second chock member being displaced axially from said post member of said first chock member, and a second protruding bar mounted to said travelling member, which second protruding bar is within the path of rotation of said post member of said second chock member when said travelling member is in said second position.

49. Apparatus of claim 48, wherein said chock member and said second chock member are integrally formed as part of the shaft.

50. Vending apparatus, comprising:

a casing including, at least, a structural frame, an exterior wall supported by said frame and defining an inside chamber, and an access port formed in said wall of said casing and defining a passage from the outside environment to said inside chamber;

a conveyor member mounted within a said chamber of said casing for movement through a predefined path within said chamber;

a plurality of receptacles mounted to said conveyor member and spaced apart along said predefined path, said receptacles moving with said conveyor member, each said receptacle being capable of holding at least one object to be vended;

a shaft mounted to said frame, said shaft being mounted for rotation about its elongated axis which elongated axis defines its axis of rotation;

conveyor engaging means for effecting movement of said conveyor member through said path in response to rotation of said shaft;

shaft rotating means for rotating the shaft about the axis of rotation;

a chock member mounted to the shaft for rotation with said shaft, whereby blocking rotation of said chock member prevents rotation of said shaft, said chock member comprising, at least, a post member projecting radially outward from the axis of rotation;

a travelling member prevented from rotation with said shaft, said travelling member comprising, at least, a protruding bar, and said travelling member being movable between a first position in which said bar is within the path of rotation of said post member of said chock member and a second postion in which said bar is not within the path of rotation of said post member of said chock member;

biasing means for biasing said travelling member to said first position;

positioning means for at least temporarily overcoming said biasing and moving said travelling member from said first position to said second position;

rotation arrest means for preventing rotation of said shaft beyond a predefined angular displacement when said travelling member is in said second position;

locking means for preventing movement of said travelling member by said positioning means; and releasing means for releasing said locking means in response to satisfaction of a defined prerequisite to thus allow movement of said travelling member by said positioning means.

51. Apparatus of claim 50, wherein said defined prerequisite to which said releasing means responds is an insertion of coins.

52. Apparatus of claim 50, wherein said defined prerequisite to which said releasing means responds is the detection of a coded entry.

53. Vending apparatus, comprising:

a casing including, at least, a structural frame, an exterior wall supported by said frame and defining an inside chamber, and an access port formed in said wall of said casing and defining a passage from the outside environment to said inside chamber;

a conveyor member mounted within said chamber of said casing for movement through a predefined path within said chamber;

a plurality of receptacles mounted to said conveyor member and spaced apart along said predefined path, said receptacles moving with said conveyor member, each said receptacle being capable of holding at least one object to be vended;

a shaft mounted to said frame, said shaft being mounted for rotation about its elongated axis which elongated axis defines its axis of rotation;

conveyor engaging means for effecting movement of said conveyor member through said path in response to rotation of said shaft;

shaft rotating means for rotating the shaft about the axis of rotation;

a chock member mounted to the shaft for rotation with said shaft, whereby blocking rotation of said chock member prevents rotation of said shaft, said chock member comprising, at least, a post member projecting radially outward from the axis of rotation;

a travelling member prevented from rotation with said shaft, said travelling member comprising, at least, a protruding bar, and said travelling member being movable between a first position in which said bar is within the path of rotation of said post member of said chock member and a second position in which said bar is not within the path of rotation of said post member of said chock member;

biasing means for biasing said travelling member to said first position;

positioning means for at least temporarily overcoming said biasing and moving said travelling member from said first position to said second position, said positioning means comprising, at least, force applying means for applying a force on said travelling member to overcome said biasing and to move said travelling member from said first position to said second position, and latch means for releasably holding said travelling member in said second position after said force is removed, said latch means releasing the hold on said travelling member in response to rotation of said shaft; and rotation arrest means for preventing rotation of said shaft beyond a predefined angular displacement when said travelling member is in said second position.

54. Apparatus of claim 53, wherein said force applying means comprises, at least, means for accepting a manually exerted force and means for conveying said manually exerted force to a force applied on said travelling member.

55. Vending apparatus, comprising:

a casing including, at least, a structural frame, an exterior wall supported by said frame and defining an inside chamber, and an access port formed in said wall of said casing and defining a passage from the outside environment to said inside chamber;

a conveyor member mounted within said chamber of said casing for movement through a predefined path within said chamber;

a plurality of receptacles mounted to said conveyor member and spaced apart along said predefined path, said receptacles moving with said conveyor member, each said receptacle being capable of holding at least one object to be vended;

a shaft mounted to said frame, said shaft being mounted for rotation about its elongated axis which elongated axis defines its axis of rotation;

conveyor engaging means for effecting movement of said conveyor member through said path in response to rotation of said shaft;

shaft rotating means for rotating the shaft about the axis of rotation:

a chock member mounted to the shaft for rotation with said shaft, whereby blocking rotation of said chock member prevents rotation of said shaft, said chock member comprising, at least, a post member projecting radially outward from the axis of rotation;

a travelling member prevented from rotation with said shaft, said travelling member comprising, at least, a protruding bar, and said travelling member being movable between a first position in which said bar is within the path of rotation of said post member of said chock member and a second position in which said bar is not within the path of rotation of said post member of said chock member;

biasing means for biasing said travelling member to said first position;

positioning means for at least temporarily overcoming said biasing and moving said travelling member from said first position to said second position; and rotation arrest means for preventing rotation of said shaft beyond a predefined angular displacement when said travelling member is in said second position, said rotation arrest means comprising, at least, a second chock member mounted to said shaft for rotation with said shaft, whereby blocking rotation of said second chock member prevents rotation of said shaft, said second chock member comprising, at least, a post member projecting radially outward from the axis of rotation, said post member of said second chock member being displaced axially from said post member of said first chock member, and a second protruding bar mounted to said travelling member which second protruding bar is within the path of rotation of said post member of said second chock member when said travelling member is in said second position.

56. Appartus of claim 55, wherein said chock member and said second chock member are integrally formed as part of said shaft.

* * * * *